US010252528B2

(12) United States Patent
Kawakubo et al.

(10) Patent No.: US 10,252,528 B2
(45) Date of Patent: Apr. 9, 2019

(54) INKJET RECORDING HEAD

(71) Applicants: KABUSHIKI KAISHA TOSHIBA, Tokyo (JP); TOSHIBA TEC KABUSHIKI KAISHA, Tokyo (JP)

(72) Inventors: Takashi Kawakubo, Yokohama Kanagawa (JP); Kazuhide Abe, Kawasaki Kanagawa (JP); Ryutaro Kusunoki, Mishima Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/687,325

(22) Filed: Aug. 25, 2017

(65) Prior Publication Data

US 2018/0194134 A1 Jul. 12, 2018

(30) Foreign Application Priority Data

Jan. 6, 2017 (JP) ..... 2017-001217

(51) Int. Cl.
*B41J 2/14* (2006.01)
*B41J 2/175* (2006.01)
(Continued)

(52) U.S. Cl.
CPC ..... *B41J 2/145* (2013.01); *B41J 2/14201* (2013.01); *B41J 2/1607* (2013.01); *B41J 2/1623* (2013.01);
(Continued)

(58) Field of Classification Search
CPC ..... B41J 2/145; B41J 2/175; B41J 2/14032
See application file for complete search history.

(56) References Cited

U.S. PATENT DOCUMENTS 6,336,717 B1 1/2002 Shimada et al.
7,841,705 B2 11/2010 Takahashi
(Continued)

FOREIGN PATENT DOCUMENTS

JP 2000-211134 8/2000
JP 2000-263785 9/2000
(Continued)

OTHER PUBLICATIONS

Japanese Office Action dated Dec. 5, 2917, filed in counterpart Japanese Patent Application No. 2017-001217, 15 pages (with translation).
(Continued)

*Primary Examiner* — Jason S Uhlenhake
(74) *Attorney, Agent, or Firm* — Kim & Stewart LLP

(57) ABSTRACT

According to one embodiment, an inkjet recording head includes a plurality of ink pressure chambers arranged in a first direction, a nozzle communicating with each of the ink pressure chambers, a plurality of individual ink supply paths which are arranged in a second direction and communicate with one end of each of the ink pressure chambers, a plurality of individual ink discharge paths which are arranged in the second direction and communicate with another end of each of the ink pressure chambers, a plurality of actuators configured to apply pressure to ink in the ink pressure chambers, a common ink supply path communicating with an end of each of the individual ink supply paths, and a common ink discharge path communicating with an end of each of the individual ink discharge paths.

13 Claims, 17 Drawing Sheets

(51) Int. Cl.
*B41J 2/145* (2006.01)
*B41J 2/16* (2006.01)

(52) U.S. Cl.
CPC ..... *B41J 2/1628* (2013.01); *B41J 2/1629* (2013.01); *B41J 2/1631* (2013.01); *B41J 2/1635* (2013.01); *B41J 2/1642* (2013.01); *B41J 2/1646* (2013.01); *B41J 2/175* (2013.01); *B41J 2202/12* (2013.01); *B41J 2202/15* (2013.01)

(56) References Cited

U.S. PATENT DOCUMENTS

| | | | | |
|---|---|---|---|---|
| 9,707,756 | B2 | 7/2017 | Kusunoki et al. | |
| 2004/0017438 | A1* | 1/2004 | Pollard | B41J 2/1404 347/65 |
| 2004/0140732 | A1 | 7/2004 | Truninger et al. | |
| 2008/0012907 | A1 | 1/2008 | Takahashi | |
| 2008/0074472 | A1* | 3/2008 | Takahashi | B41J 2/161 347/68 |
| 2011/0216129 | A1 | 9/2011 | Kusunoki et al. | |
| 2011/0234668 | A1 | 9/2011 | Hoisington et al. | |
| 2013/0063522 | A1 | 3/2013 | Arai et al. | |
| 2013/0258001 | A1 | 10/2013 | Sato et al. | |
| 2015/0062254 | A1 | 3/2015 | Kawakubo et al. | |
| 2015/0085022 | A1 | 3/2015 | Kawakubo et al. | |
| 2015/0273831 | A1 | 10/2015 | Hirai | |
| 2016/0052272 | A1 | 2/2016 | Kawakubo et al. | |
| 2016/0279942 | A1 | 9/2016 | Kusunoki et al. | |

FOREIGN PATENT DOCUMENTS

| | | | |
|---|---|---|---|
| JP | 2004-58677 | | 2/2004 |
| JP | 2008-010528 | | 1/2008 |
| JP | 2008-74020 | | 4/2008 |
| JP | 2011-178055 | | 9/2011 |
| JP | 2011-207228 | | 10/2011 |
| JP | 2013-075510 | | 4/2013 |
| JP | 2013-202938 | | 10/2013 |
| JP | 2014172323 | | 9/2014 |
| JP | 2015-047726 | | 3/2015 |
| JP | 2015-058666 | | 3/2015 |
| JP | 2015-182441 | | 10/2015 |
| JP | 2015-217665 | | 12/2015 |
| JP | 2016-043509 | | 4/2016 |
| JP | 2016-49639 | | 4/2016 |
| JP | 2016-49677 | | 4/2016 |
| JP | 201649677 | A2 * | 4/2016 |
| JP | 2016049639 | A2 * | 4/2016 |
| JP | 2016-104220 | | 6/2016 |
| JP | 2016-105057 | | 6/2016 |
| JP | 2016-117254 | | 6/2016 |
| JP | 2016-179555 | | 10/2016 |
| JP | 2016-203534 | | 12/2016 |
| JP | 6117403 | B1 | 4/2017 |
| JP | 6171051 | B1 | 7/2017 |

OTHER PUBLICATIONS

Japanese Office Action dated Oct. 30, 2018, mailed in counterpart Japanese Application No. 2018-018475, 8 pages (with translation).

* cited by examiner

INKJET RECORDING HEAD

CROSS-REFERENCE TO RELATED APPLICATION

This application is based upon and claims the benefit of priority from Japanese Patent Application No. 2017-001217, filed Jan. 6, 2017; the entire contents of which are incorporated herein by reference.

FIELD

Embodiments described herein relate generally to a type of inkjet recording head that circulates ink in an ink pressure chamber communicating with a nozzle.

BACKGROUND

An inkjet recording head comprises a nozzle that discharges droplets of ink, an ink pressure chamber communicating with the nozzle, and an actuator that applies pressure to the ink in the ink pressure chamber. This head drives the actuator to apply pressure to the ink in the ink pressure chamber and discharge droplets of ink from the nozzle.

A piezoelectric type actuator, for example, is known as a type of actuator that discharges droplets of ink by deforming and displacing the wall (vibration plate) of an ink pressure chamber using a piezoelectric element. An advantage of the piezoelectric type actuator is freedom from constraints on the type of ink to be used, since the piezoelectric element does not directly contact the ink, and the heat generated by the piezoelectric element may be ignored. Thus, a piezoelectric MEMS type inkjet recording head developed by applying the semiconductor processing technology to such a piezoelectric type actuator is drawing attention.

When pressure is applied to ink in an ink pressure chamber and droplets of the ink are discharged from a nozzle, the pressure of the ink in the ink pressure chamber needs to be maintained in order to obtain a sufficient discharge pressure. Therefore, a narrow portion (an orifice) is typically provided between an ink pressure chamber and an ink supply path.

Meanwhile, air bubbles formed in the ink pressure chamber during an ink discharge operation absorb the pressure for discharging ink droplets, resulting in poor discharge. Therefore, a head designed to remove air bubbles by circulating ink in an ink pressure chamber is known.

However, an orifice provided on the ink supply path prevents the ink from smoothly flowing, resulting in insufficient removal of air bubbles.

Under the circumstances, there is a demand for an inkjet recording head that favorably discharges ink droplets at a sufficient discharge pressure.

DETAILED DESCRIPTION

According to one embodiment, an inkjet recording head includes a plurality of ink pressure chambers arranged in a first direction, a nozzle communicating with each of the ink pressure chambers, a plurality of individual ink supply paths which are arranged in a second direction intersecting the first direction in such a manner that each of the individual ink supply paths communicates with one end of a corresponding one of the ink pressure chambers as viewed in the first direction, and which individually supply ink to the respective ink pressure chambers, a plurality of individual ink discharge paths which are arranged in the second direction in such a manner that each of the individual ink discharge paths communicates with another end of the corresponding ink pressure chamber as viewed in the first direction, and which individually discharge ink from the respective ink pressure chambers, a plurality of actuators configured to apply pressure to ink in the ink pressure chambers, a common ink supply path communicating with an end of each of the individual ink supply paths on a side opposite to the corresponding ink pressure chamber, and a common ink discharge path communicating with an end of each of the individual ink discharge paths on a side opposite to the corresponding ink pressure chamber.

Various Embodiments will be described hereinafter with reference to the accompanying drawings.

(First Embodiment)

Figure 1:
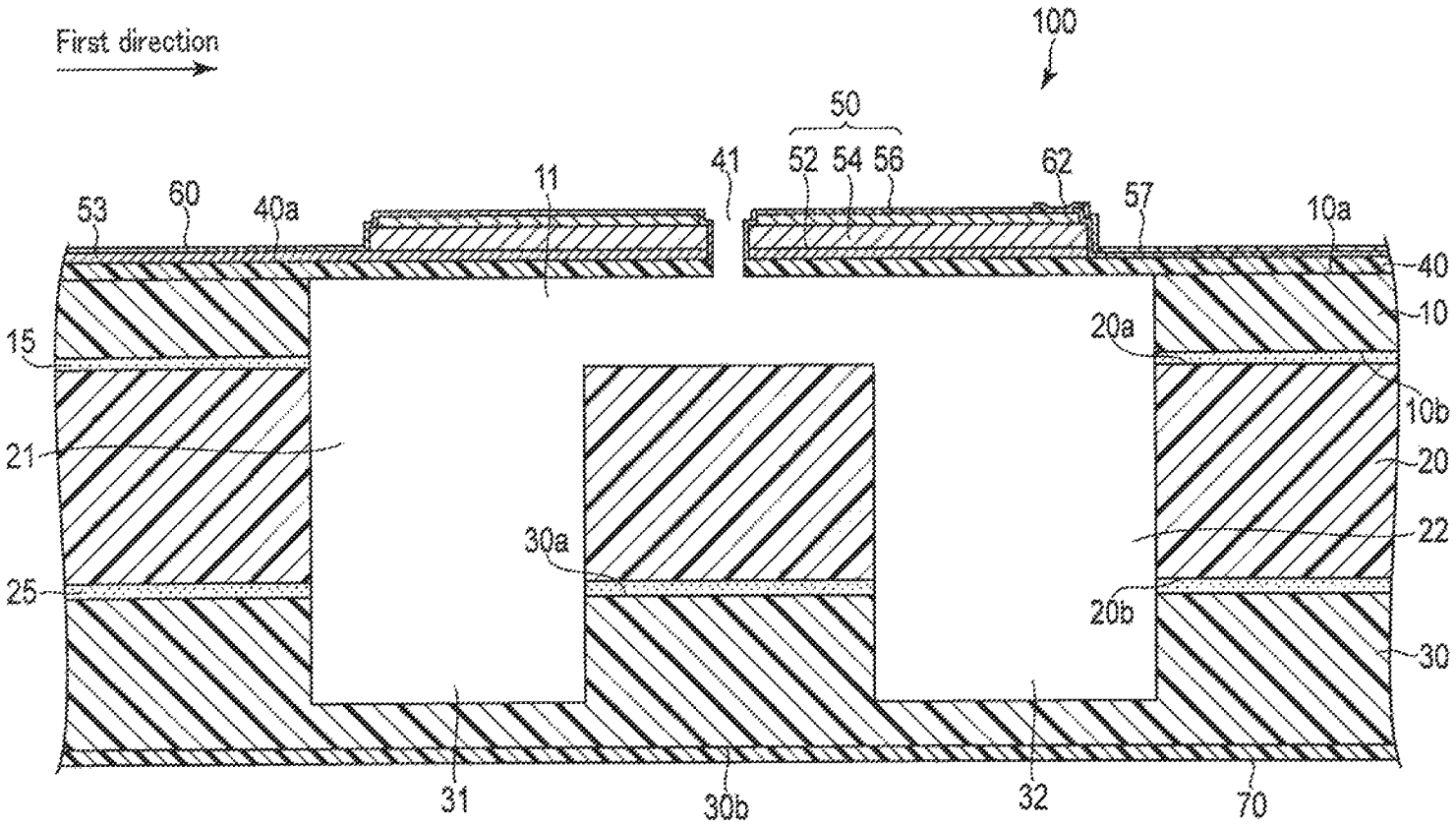
FIG. 1 is a partially enlarged cross-sectional view showing the main part of an inkjet recording head according to the first embodiment.
Figure 2:
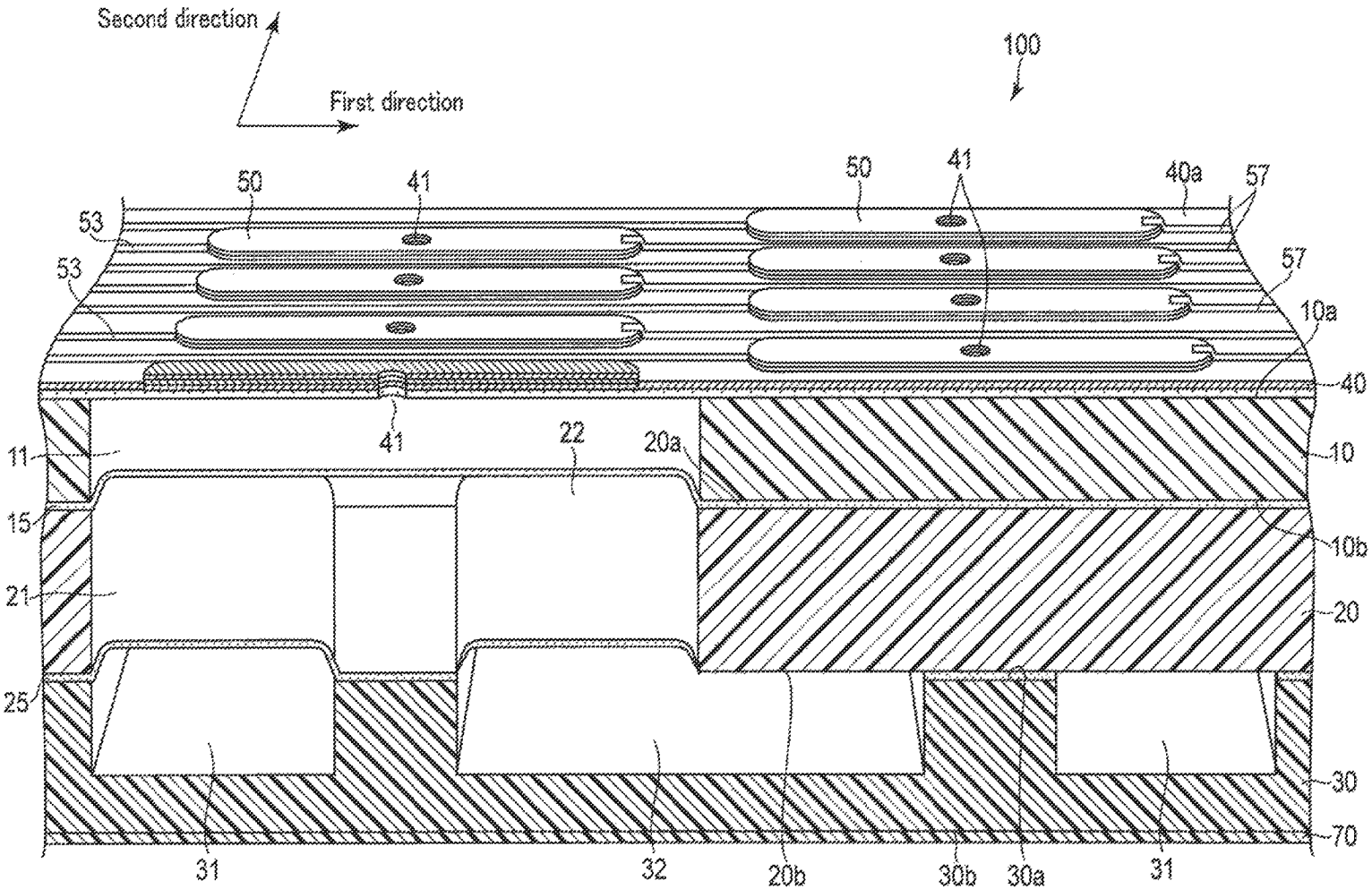
FIG. 2 is a schematic perspective view showing a part of the inkjet recording head comprising a plurality of structures, each corresponding to the structure of FIG. 1.

FIG. 1 is a partially enlarged cross-sectional view showing the main part of an inkjet recording head 100 (hereinafter simply referred to as a head 100) according to the first embodiment. FIG. 2 is a schematic perspective view showing a part of the head 100, which comprises a plurality of structures each corresponding to the structure of FIG. 1. In FIG. 2, an insulating film 60 is not shown, for the sake of easy recognition of piezoelectric elements 50 and the wiring structures thereof. As shown in FIG. 2, the head 100 comprises, on its surface, a plurality of piezoelectric elements 50 arranged in a matrix. The number of rows and columns of the piezoelectric elements 50 may be changed as appropriate.

The head 100 of the present embodiment is a piezoelectric MEMS type inkjet recording head. The head 100 comprises a driving substrate (first substrate) 10, a channel substrate (second substrate) 20, a supply substrate (third substrate) 30, all of which may be composed of, for example, silicon, a nozzle plate (vibration plate) 40 composed of a silicon dioxide film (thermally-oxidized film), and a plurality of piezoelectric elements (actuators) 50. An insulating film 60 is provided on a surface 40*a* of the nozzle plate 40, which comprises the piezoelectric elements 50, on the side away from the driving substrate 10. On a back surface of the supply substrate 30 on the side away from the channel substrate 20, a thermally-oxidized film 70, composed of a silicon dioxide film, is provided.

The driving substrate 10 includes a plurality of elongated ink pressure chambers 11 communicating with a first surface 10*a* (surface away from the channel substrate 20) and a second surface 10*b* (surface on the side of the channel substrate 20) and penetrating the substrate. The ink pressure chambers 11 are elongated holes each extending in a first direction (hereinafter also referred to as a longitudinal direction) along the plane direction of the driving substrate 10, and are arranged at a certain pitch in an arrangement direction along the plane direction orthogonal to the first direction.

The ink pressure chambers 11 are provided so as to correspond one-to-one to the piezoelectric elements 50 provided on a surface of the head 100. As shown in FIG. 2, the piezoelectric elements 50 have an approximately oval outer shape extending in the first direction, and are arranged in a plurality of columns (only two of which are shown in FIG. 2). For the wiring of the piezoelectric elements 50, two adjacent columns of the piezoelectric elements 50 are laid out in a half-pitch staggered manner in the arrangement direction. That is, two adjacent rows of the ink pressure chambers 11 provided in the driving substrate 10 are also arranged in a half-pitch staggered manner in the arrangement direction.

The ends of the ink pressure chambers 11 of each of the columns as viewed in the longitudinal direction are aligned in the arrangement direction. Each of the ink pressure chambers has a length of approximately 200 to 600 μm along the longitudinal direction, and a width of approximately 50 to 100 μm along the arrangement direction. The pitch of the ink pressure chambers 11 in the arrangement direction is approximately 60 to 150 μm. In the present embodiment, the cross-sectional shape of the ink pressure chamber 11 is approximately oval, in a size slightly greater than that of the piezoelectric element 50.

The driving substrate 10 has a thickness of, for example, 50 to 300 μm, desirably 30 to 200 μm. The thickness of the driving substrate 10 is designed so as to allow the partition wall between the ink pressure chambers 11 arranged adjacent to each other in the arrangement direction to have a sufficient rigidity, to make the array density of the ink pressure chamber 11 as high as possible, and to make the volume of the ink pressure chamber 11 an appropriate value. The thickness of the driving substrate 10 corresponds to the depth of each of the ink pressure chambers 11.

The channel substrate 20 is, for example, bonded to the second surface 10*b* of the driving substrate 10 via an adhesive 15. The channel substrate 20 includes a plurality of individual ink supply paths 21 and a plurality of individual ink discharge paths 22, which communicate with the first surface 20*a* (surface on the side of the driving substrate 10) and the second surface 20*b* (surface away from the driving substrate 10) so as to penetrate the substrate. The individual ink supply paths 21 and the individual ink discharge paths 22 are assigned one-to-one to the ink pressure chambers 11 of the driving substrate 10, and are formed in advance in the channel substrate 20 by a known method. The length of each of the individual ink supply path 21 and the individual ink discharge path 22 corresponds to the thickness of the channel substrate 20. The individual ink supply path 21 and the individual ink discharge path 22 extend in a second direction approximately orthogonal to the longitudinal direction of the ink pressure chamber 11.

Specifically, as shown in FIG. 2, for example, the individual ink supply path 21 communicating with the ink pressure chamber 11 at the left column in the drawing is provided in a position facing the left end of the ink pressure chamber 11 in the drawing. The individual ink discharge path 22 communicating with this ink pressure chamber 11 is provided in a position facing the right end of the ink pressure chamber in the drawing. On the other hand, the individual ink supply path 21 communicating with the ink pressure chamber 11 at the right column (not shown in FIG. 2) in the drawing, is provided in a position facing the right end of the ink pressure chamber 11 in the drawing. The individual ink discharge path 22 communicating with this ink pressure chamber 11 (not shown in FIG. 2) is provided in a position facing the left end of the ink pressure chamber 11 in the drawing.

That is, the individual ink supply paths 21 and the individual ink discharge paths 22 are laid out in alternately reversed orientations along the first direction, in such a manner that the individual ink discharge paths 22 (or the individual ink supply paths 21) connected to the two adjacent rows of the ink pressure chambers 11 are adjacent to each other. This allows the individual ink discharge paths 22 (or the individual ink supply paths 21) to share the common ink discharge path 32 (or the common ink supply path 31) in two adjacent columns.

The supply substrate 30 is, for example, bonded to the second surface 20*b* of the channel substrate 20 via an adhesive 25. The supply substrate 30 includes a plurality of common ink supply paths 31 (only two of which are shown in FIG. 2) extending in the arrangement direction of the ink pressure chambers 11, and a plurality of common ink discharge paths 32 (only one of which is shown in FIG. 2) extending in the arrangement direction. The common ink supply paths 31 and the common ink discharge paths 32 are alternately arranged along the first direction. The common ink supply paths 31 and the common ink discharge paths 32 are provided in advance as bottomed grooves on the side of the first surface 30*a* of the supply substrate 30 by a known method.

Figure 3:
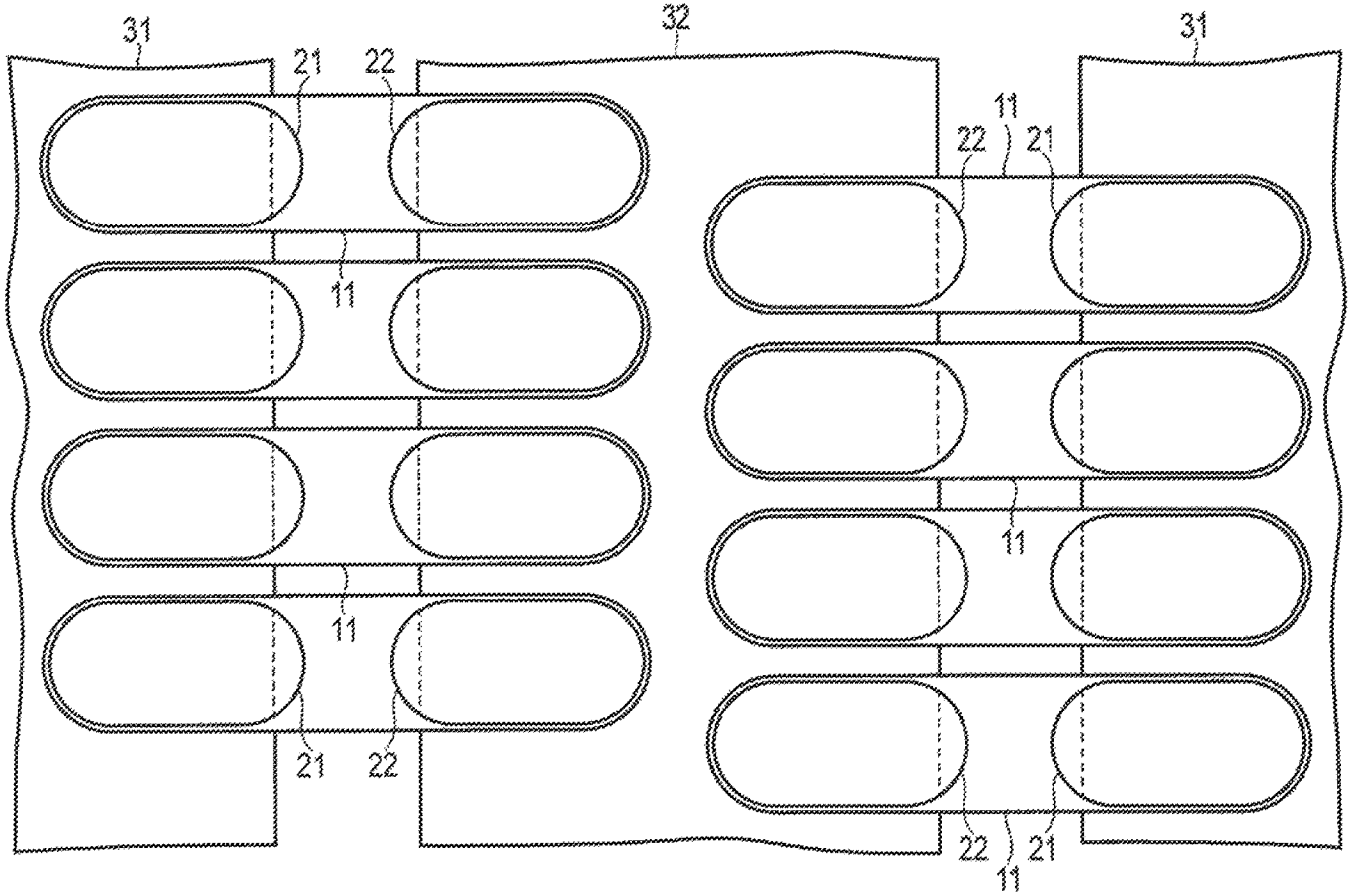
FIG. 3 is a schematic view showing how ink pressure chambers, individual ink supply paths, individual ink discharge paths, common ink supply paths, and common ink discharge paths overlap one another in the inkjet recording head shown in FIG. 2.

FIG. 3 is a schematic view illustrating how the ink pressure chambers 11, the individual ink supply paths 21, the individual ink discharge paths 22, the common ink supply paths 31, and the common ink discharge path 32 overlap one another. Each of the individual ink supply paths 21 and each of the individual ink discharge paths 22 provided so as to face respective ends of the corresponding ink pressure chamber 11 as viewed in the longitudinal direction has an oval cross-sectional shape extending along the longitudinal direction of the ink pressure chamber 11. The common ink supply path 31 is formed in a position overlapping the individual ink supply paths 21 arranged in the arrangement direction. The common ink discharge path 32 is formed in a position overlapping the individual ink discharge paths 22 arranged in the arrangement direction.

In FIGS. 2 and 3, the common ink supply path 31 connects the individual ink supply paths 21 of each column arranged in the arrangement direction, and the common ink discharge path connects the individual ink discharge paths 22 of two adjacent columns. When the ink pressure chambers 11 of three or more rows are arranged, the individual ink supply paths 21 and the individual ink discharge paths 22 of adjacent rows are made continuous via one common ink supply path 31 and one common ink discharge path 32, respectively.

The nozzle plate 40 is provided so as to contact the first surface 10*a* of the driving substrate 10 on the side away from the channel substrate 20, in such a manner that the cavity of each ink pressure chamber 11 on the side of the first surface 10*a* is filled. The nozzle plate 40 includes a plurality of nozzles 41 each communicating with the corresponding ink pressure chamber 11 and provided at the center of the ink pressure chamber 11 as viewed in the longitudinal direction. Each of the nozzles 41 is provided near the center, or more desirably, at the center of the corresponding ink pressure chamber 11 along the longitudinal direction.

The nozzles 41 provided for the respective ink pressure chambers 11 extend through the nozzle plate 40, and through the piezoelectric elements 50, which will be described later. That is, the ink pressure chambers 11 communicate with the outside of the head 100 via the nozzles 41. The distance from each nozzle 41 to both ends of the corresponding ink pressure chamber 11 as viewed in the longitudinal direction is designed to fall within approximately 100 to 300 μm.

The nozzle plate 40 is composed of a silicon dioxide film ($SiO_2$) with a thickness of approximately 1 to 5 μm, formed by, for example, thermal oxidation or chemical vapor deposition (CVD). From the viewpoint of uniform deformation, the silicon oxide film should desirably be noncrystalline. Moreover, to facilitate fabrication of a film with a stable composition and properties, the nozzle plate 40 should desirably be composed of a silicon oxide film. Furthermore, to ensure high compatibility with the conventional semiconductor manufacturing process, the nozzle plate 40 should desirably be composed of a silicon dioxide film.

The piezoelectric elements 50 are formed by being stacked on the surface 40*a* of the nozzle plate 40 so as to surround the respective nozzles 41. As shown in FIG. 1, each of the piezoelectric elements 50 includes a lower electrode 52 stacked on the surface 40*a* of the nozzle plate 40, a piezoelectric film 54 stacked on the lower electrode 52, and an upper electrode 56 stacked on the piezoelectric film 54. The length of each piezoelectric element 50 along the first direction is less than the length of each ink pressure chamber 11 along the first direction. The width of each piezoelectric element 50 along the arrangement direction is less than the width of each ink pressure chamber 11 along the arrangement direction.

A part of the lower electrode 52 of each piezoelectric element 50 extends along the surface 40*a* of the nozzle plate 40, and functions as an individual driving wiring 53. The insulating film 60 is formed on the surface 40*a* of the nozzle plate 40, including the surfaces of the piezoelectric elements 50. A via hole 62 is formed in a part of the insulating film 60 contacting the upper electrode 56, and a lead wiring 57 is drawn from the upper electrode 56 via the via hole 62. The insulating film 60 extends to a position partially covering the inner surface of the nozzle 41.

The piezoelectric film 54 of each piezoelectric element 50 is preferably composed of a piezoelectric material having a large electrostrictive constant, such as lead zirconate titanate ($Pb(Zr, Ti)O_3$, PZT). When using PZT for the piezoelectric film 54, it is preferable to use a noble metal such as Pt, Au, or Ir, or a conductive oxide such as $SrRuO_3$, for the lower electrode 52 and the upper electrode 56. For the piezoelectric film 54, a piezoelectric material suitable for a silicon process, such as AlN or $ZrO_2$, may also be used. In that case, a general electrode material or wiring material such as Al and Cu may be used for the lower electrode 52 and the upper electrode 56.

Next, the operation of the head 100 will be described.

First, ink is supplied to the head 100 from an external ink supply pump (not shown). The ink flows into the individual ink supply paths 21 of each column via the corresponding common ink supply path 31, and flows into the respective ink pressure chambers 11. The ink flowing into the ink pressure chambers 11 is discharged from an external ink discharge pump (not shown). At this time, the ink in the ink pressure chambers 11 flows into the corresponding common ink discharge path 32 via the individual ink discharge paths 22. This allows the ink to circulate in the ink pressure chambers 11. At this time, air bubbles or the like formed in the ink pressure chambers 11 are promptly discharged outside the ink pressure chambers 11.

In the present embodiment, an individual ink channel including the ink pressure chamber 11, the individual ink supply path 21, and the individual ink discharge path 22 extending in a continuous manner has a relatively large cross-sectional area over its entire length. In other words, an orifice is not provided at a midpoint of the individual ink channel in the present embodiment. This decreases the channel resistance and the viscosity resistance of the ink flowing through the individual ink channel, allowing the ink to circulate in the ink pressure chamber 11 without resistance. Specifically, the individual ink channel (11, 21, and 22) of the present embodiment has a cross-sectional area of approximately 5000 $\mu m^2$ to 30000 $\mu m^2$ over its entire length.

A driving voltage is selectively applied between the lower electrode 52 and the upper electrode 56 of each piezoelectric element 50, in accordance with a recording signal from an external driving circuit (not shown), while the ink circulates in the ink pressure chambers 11, as described above. This causes the piezoelectric film 54 of the piezoelectric element 50 applied with the driving voltage to contract, deforms the piezoelectric element 50 to be bent in a concave shape, and increases the volume of the corresponding ink pressure chamber 11, thus allowing the ink to flow into the ink pressure chamber 11 via the individual ink supply path 21. When the driving voltage is removed, the deformed piezoelectric element 50 returns to its original shape, decreases the volume of the ink pressure chamber 11, and increases the pressure in the ink pressure chamber 11, thus discharging ink droplets via the nozzle 41.

To favorably discharge ink droplets at a sufficient discharge pressure, the pressure of the ink in the ink pressure chamber 11 at the time of discharge of ink droplets needs to be kept above a certain level. Thus, in the present embodiment, the individual ink channel (the individual ink supply path 21, the ink pressure chamber 11, and the individual ink discharge path 22) of ink individually flowing through each ink pressure chamber 11 has a sufficiently great length, thereby making the distance between the nozzle 41 and the common ink supply path 31 and the distance between the nozzle 41 and the common ink discharge path 32 sufficiently long. This produces an inertial resistance caused by the inertial mass of the ink filling the ink pressure chamber 11, and suppresses the pressure from escaping from the ink pressure chamber 11 to the common ink supply path 31 and the common ink discharge path 32.

In other words, a length that is great enough to obtain a discharge pressure sufficient for allowing ink droplets to be discharged is ensured for the ink pressure chamber 11, the individual ink supply path 21, and the individual ink discharge path 22 of the head 100 of the present embodiment.

Specifically, the ink pressure chamber 11, the individual ink supply path 21, and the individual ink discharge path 22 are set to have a length that is great enough to allow vibration waves (hereinafter referred to as pressure waves) generated by a change in pressure of ink at the time of discharge of ink droplets to sufficiently attenuate before the pressure waves reach the common ink supply path 31 and the common ink discharge path 32, and to hardly transmit the vibration to the common ink supply path 31 and the common ink discharge path 32.

This allows the ink droplets to be discharged at a sufficient discharge pressure from each ink pressure chamber 11, and prevents the problem of pressure waves being transmitted to other ink pressure chambers 11 adjacent thereto via the common ink supply path 31 and the common ink discharge path 32, without causing an adverse effect on the ink droplet discharge operation at the adjacent ink pressure chambers 11.

Figure 4:
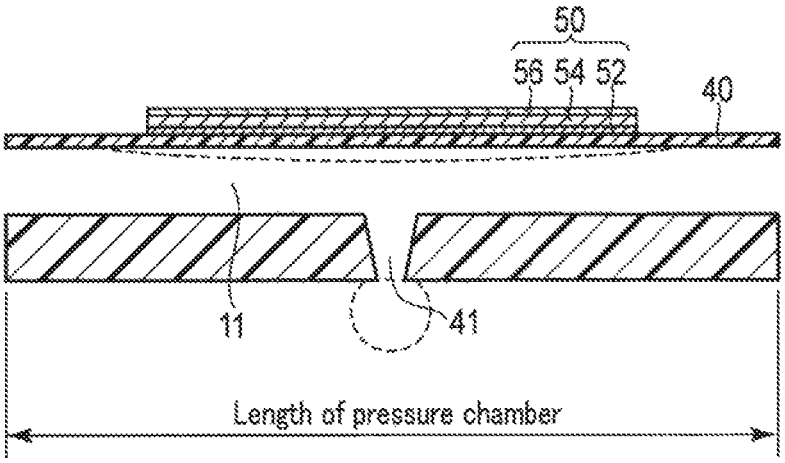
FIG. 4 is a schematic cross-sectional view showing a head model for determining the relationship between the length of an ink pressure chamber and the volume of an ink droplet.
Figure 5:
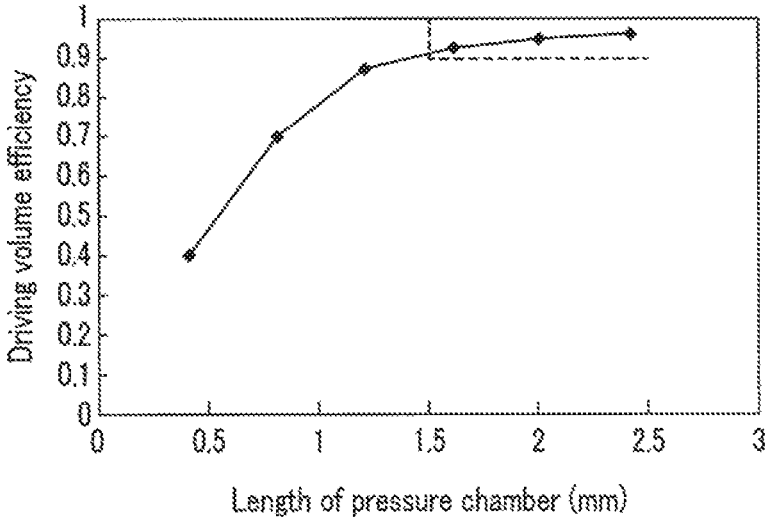
FIG. 5 is a graph showing results of simulation using the head model shown in FIG. 4.

To determine the length of the individual ink channel (11, 21, and 22) optimum for sufficiently attenuating the pressure waves generated by discharge of an ink droplet, the length of the ink pressure chamber 11 was variously changed using the type of head (head that does not include an individual ink supply path 21 and an individual ink discharge path 22) shown in FIG. 4. The change in volume of the ink droplet discharged from the nozzle 41 in such a case was computationally simulated. The results of the simulation are shown in FIG. 5.

According to the results, the volume of an ink droplet reaches approximately 80% of the ideal volume (volume of an ink droplet in a state in which the pressure of the ink pressure chamber 11 is completely confined) when the length of the ink pressure chamber 11 (which is open-ended) with the nozzle 41 at the center exceeds 1 mm. In such a case, it is known that the width and depth of the ink pressure chamber 11, namely, the cross-sectional area of the ink pressure chamber 11 hardly affects the volume of an ink droplet. That is, it can be understood in this case that the pressure waves can be sufficiently attenuated at both ends of the ink pressure chamber 11 by setting the length of the ink pressure chamber 11 from the nozzle 41 at each of the sides of the nozzle 41 to be 500 μm or greater, thus allowing ink droplets of a sufficient size to be stably discharged.

However, given that an increase in length of the ink pressure chamber 11 leads to an increase in the size of the head 100, the length of the ink pressure chamber 11 should desirably be as small as possible. According to the simulation results shown in FIG. 5, when the length of the ink pressure chamber 11 approaches 2500 μm, the size of an ink droplet becomes saturated and exceeds 95% of the ideal volume. Accordingly, the length of the ink pressure chamber 11 should desirably be 2500 μm or less.

However, when the ink pressure chamber 11 simply extends in a straight manner, as shown in FIG. 4, the head 100 increases in size in the plane direction, and the nozzles 41 cannot be arranged in high density, resulting in a decrease in design flexibility and driving efficiency. Thus, in the present embodiment, each ink pressure chamber 11 has a small length, and the individual ink supply path 21 and the individual ink discharge path 22 are provided so as to communicate with both ends of the ink pressure chamber 11 and extend in a direction intersecting the ink pressure chamber 11, thereby securing a sufficient length for the individual ink channel.

Specifically, in the present embodiment, the length of the channel extending from the nozzle 41 through the ink pressure chamber 11 and the individual ink supply path 21 to the common ink supply path 31 and the length of the channel extending from the nozzle 41 through the ink pressure chamber 11 and the individual ink discharge path 22 to the common ink discharge path 32 are set to approximately 500 to 1250 μm. Alternatively, in the present embodiment, the sum of the thickness of the driving substrate 10, in which the ink pressure chamber 11 is provided, and the thickness of the channel substrate 20, in which the individual ink supply path 21 and the individual ink discharge path 22 are provided, is set to 500 μm or greater.

As described above, the head 100 of the present embodiment allows for high-density arrangement of the piezoelectric elements 50 along the surface of the head 100, and allows for higher-density arrangement of the nozzles 41, thereby reducing the size of the device configuration.

Furthermore, according to the present embodiment, the individual ink channel (11, 21, and 22) leading to the nozzle 41 can be made sufficiently long, without increasing the size of the head 100, and the pressure waves generated at the nozzle 41 at the time of discharge of ink droplets are sufficiently attenuated, thus allowing ink droplets of a sufficient size to be stably discharged at a sufficient discharge pressure.

A method of manufacturing the head 100 will be described below with reference to FIGS. 6-14.

Figure 6:
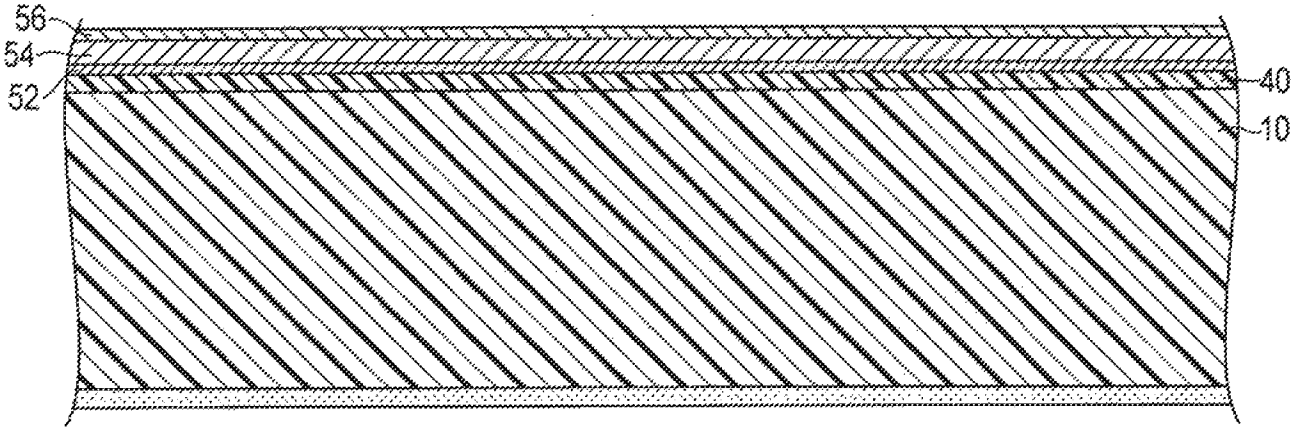
FIGS. 6-14 are cross-sectional views illustrating a method of manufacturing the inkjet recording head shown in FIG. 1.

First, as shown in FIG. 6, a nozzle plate 40, composed of a silicon dioxide film, is formed by oxidizing a driving substrate 10 by thermal oxidation. In the present embodiment, the nozzle plate 40 is formed by thermal oxidation of the silicon substrate, but may be formed using techniques other than thermal oxidation, such as plasma-enhanced chemical vapor deposition (PECVD) and CVD using tetraethyl orthosilicate (TEOS) as a raw material.

Thereafter, as shown in FIG. 6, a Ti/Pt layer is formed as a lower electrode 52 on the nozzle plate 40 by sputtering, and a PZT layer is formed thereon as a piezoelectric film 54, and an Au layer is further formed thereon as an upper electrode 56.

Figure 7:
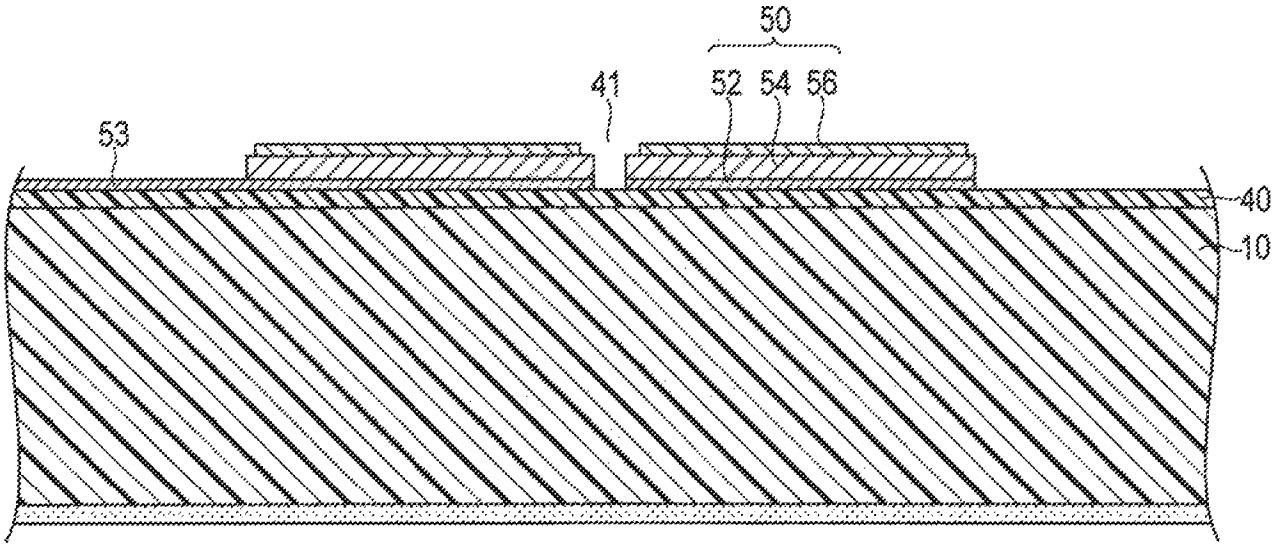

Next, as shown in FIG. 7, the upper electrode 56, the piezoelectric film 54, and the lower electrode 52 are sequentially etched and patterned by photolithography and wet or dry etching, thereby forming a plurality of piezoelectric elements 50, a part of a plurality of nozzles 41, and a plurality of individual driving wirings 53.

Figure 8:
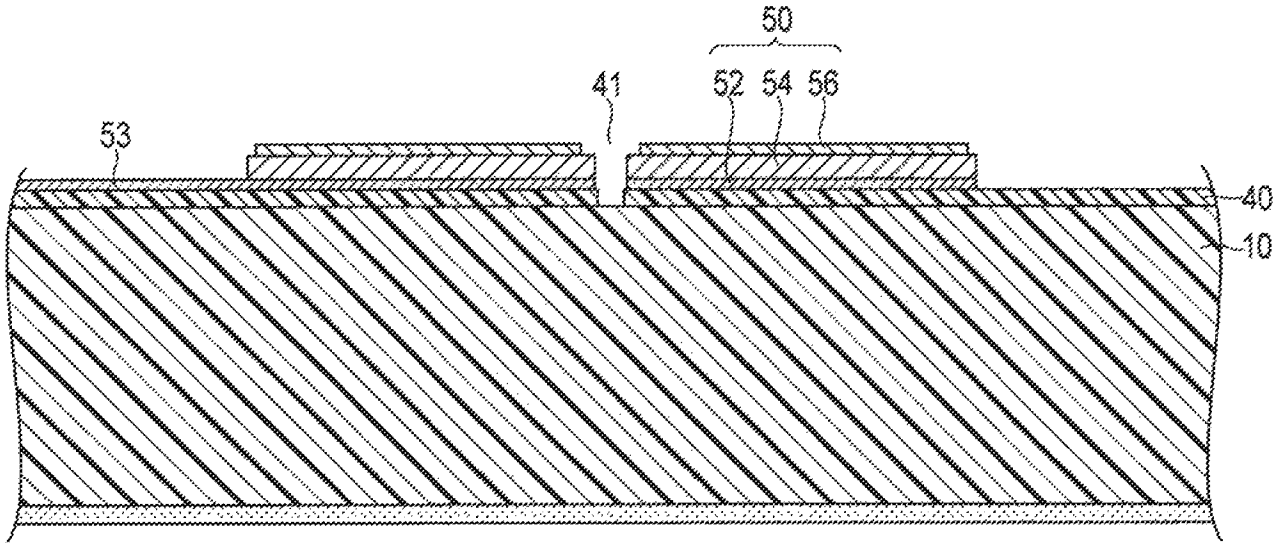

Next, as shown in FIG. 8, the nozzle plate 40 is patterned by photolithography and reactive ion etching, thus forming the nozzles 41.

Figure 9:
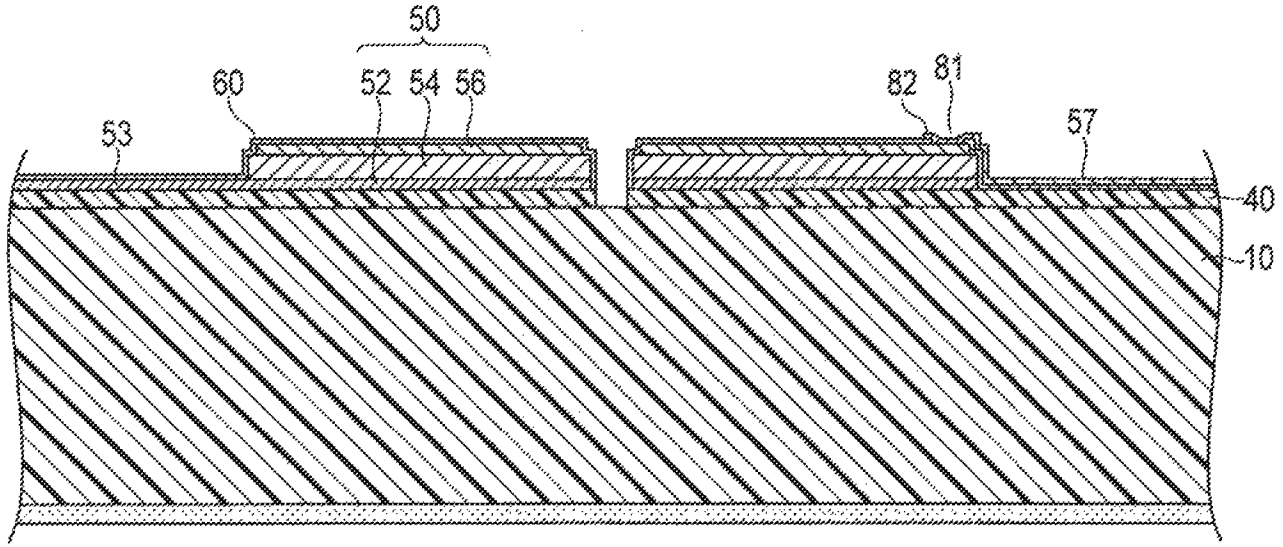

Next, as shown in FIG. 9, an insulating film 60 is formed on the entire surface of the nozzle plate 40 and the piezoelectric elements 50, and patterned by photolithography and reactive ion etching, thus forming a plurality of via holes 81 on the upper electrode 56.

Thereafter, as shown in FIG. 9, the via holes 81 are patterned by sputtering deposition, photolithography, and reactive ion etching, thereby forming a contact 82 with the upper electrode 56 in each of the via holes 81 and forming a plurality of lead wirings 57 connected to the contact 82.

Figure 10:
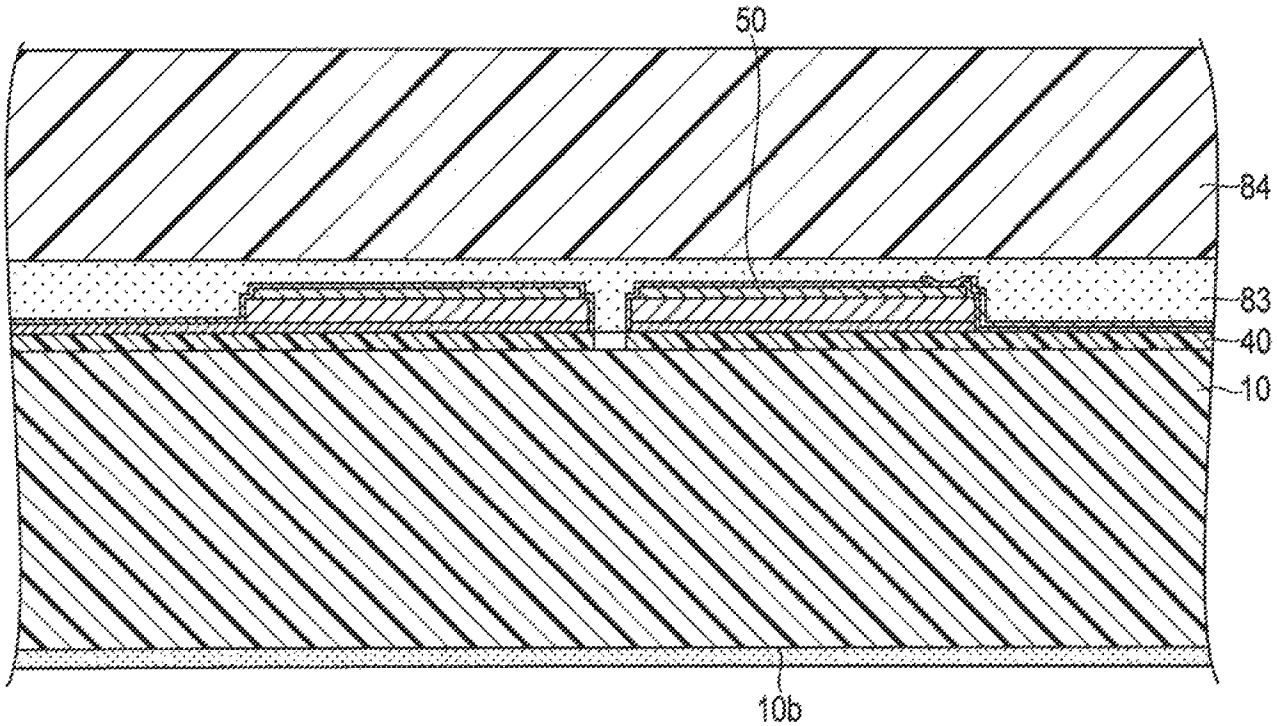

Next, as shown in FIG. 10, a temporarily-fixed substrate 84 is fixed on the insulating film 60 via a temporary fixing adhesive 83.

Figure 11:
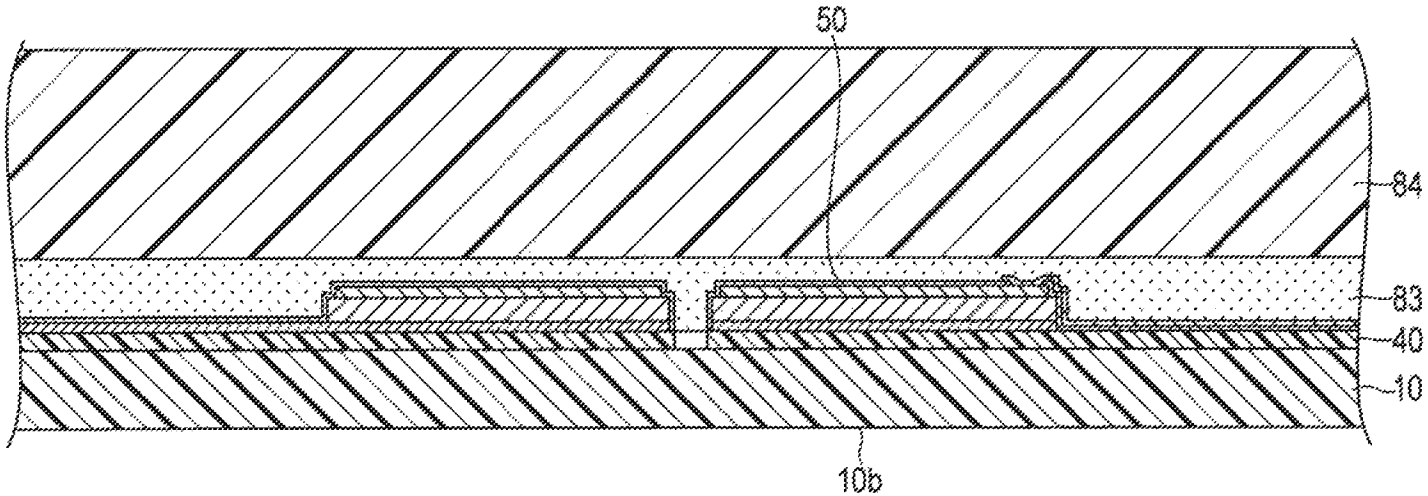

Next, as shown in FIG. 11, the driving substrate 10 is ground from the side of a second surface 10*b*, and processed by chemical mechanical planarization (CMP), for thinning.

Figure 12:
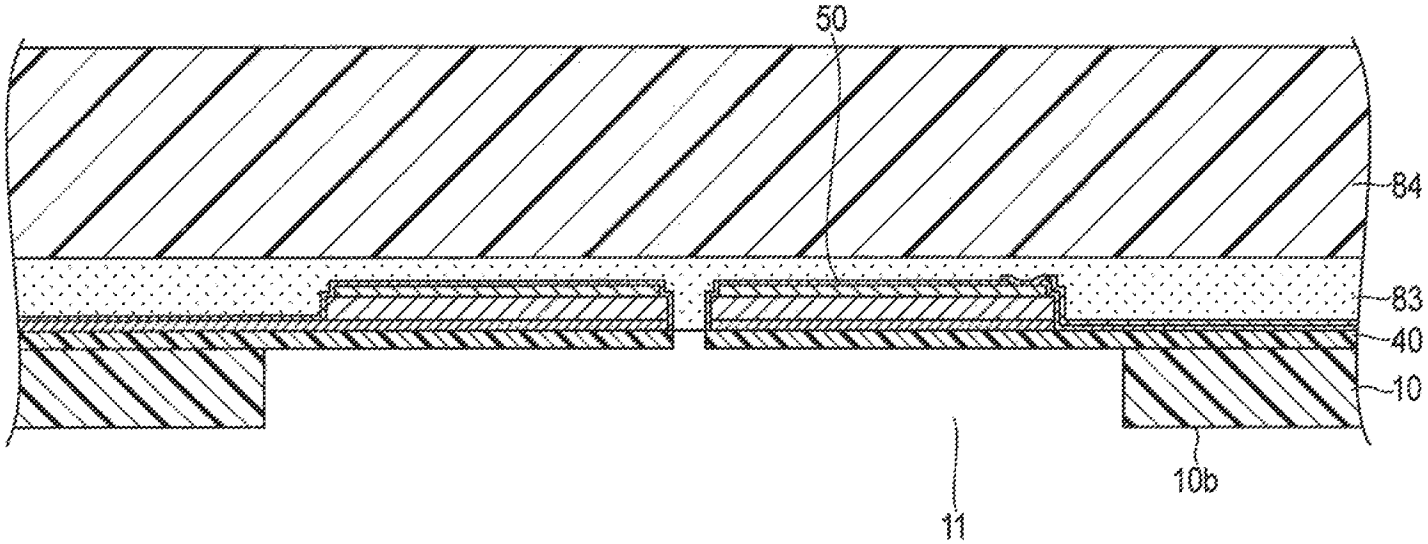

Next, as shown in FIG. 12, a plurality of ink pressure chambers 11 are formed by performing back-side photolithography and deep reactive-ion etching (DRIE) from the side of the second surface 10*b* of the driving substrate 10. At this time, etching and passivation of the driving substrate 10 are repeated several times to form the ink pressure chambers 11 with a desired depth.

Figure 13:
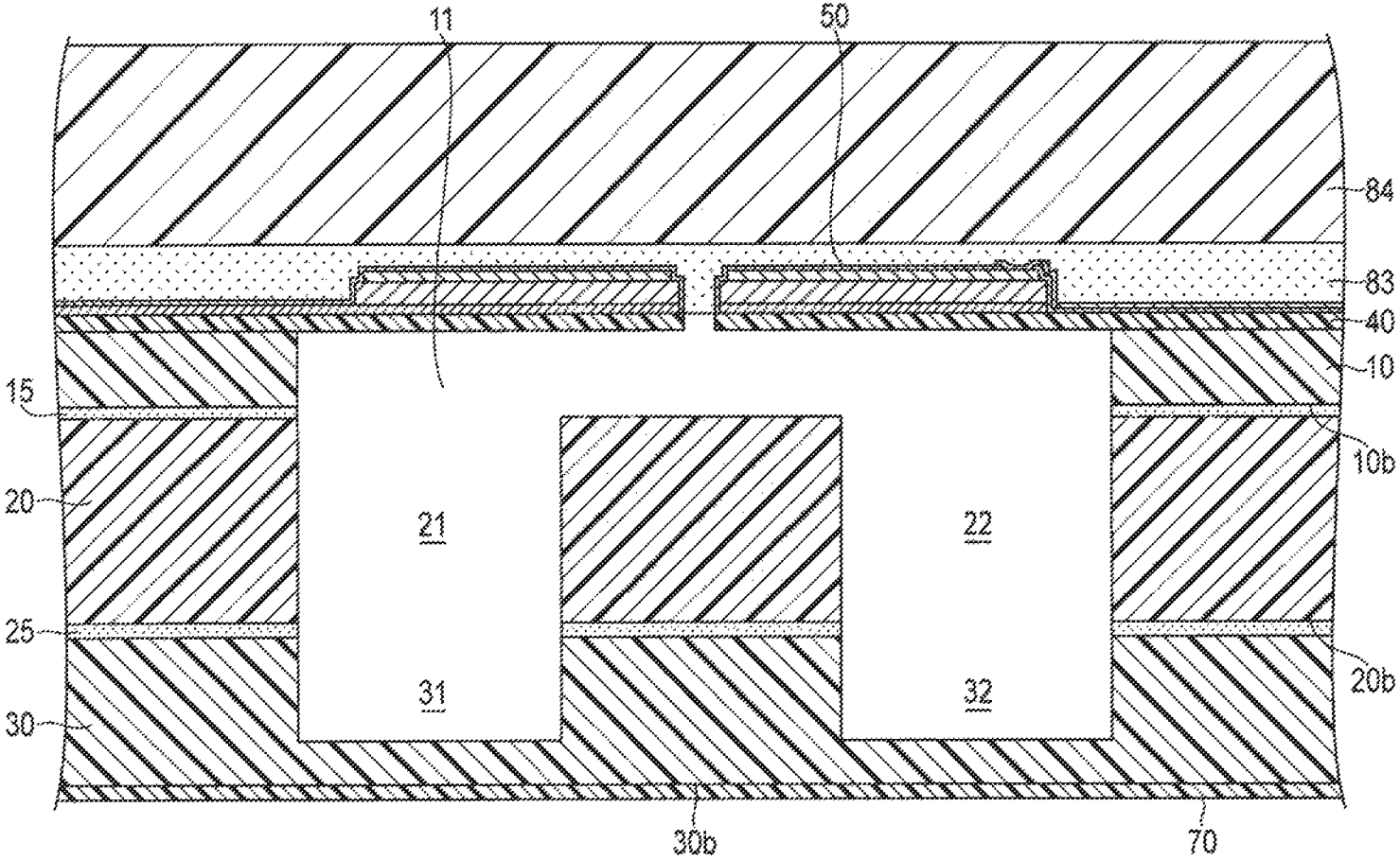

Next, as shown in FIG. 13, a channel substrate 20, in which the individual ink supply paths 21 and the individual ink discharge paths 22 are formed in advance, is bonded to the second surface 10*b* of the driving substrate 10 via an adhesive 15. At this time, the channel substrate 20 is positioned in the plane direction with respect to the driving substrate 10, in such a manner that each of the individual ink supply paths and each of the individual ink discharge paths 22 face respective ends of the corresponding ink pressure chamber 11 of the driving substrate 10 as viewed in the longitudinal direction. This allows the individual ink supply path 21 and the individual ink discharge path 22 to communicate with the respective ends of each of the ink pressure chambers 11.

Furthermore, as shown in FIG. 13, a supply substrate 30, in which a plurality of common ink supply paths 31 and a plurality of common ink discharge paths 32 are formed in advance, is bonded to the second surface 20*b* of the channel substrate 20 via an adhesive 25. At this time, the supply substrate 30 is positioned in the plane direction with respect to the channel substrate 20, in such a manner that the common ink supply path 31 faces the individual ink supply paths 21 in the channel substrate 20 arranged in the second direction, and the common ink discharge path 32 faces the individual ink discharge paths 22. This allows the common ink supply path 31 to communicate with the individual ink supply paths 21, and allows the common ink discharge path 32 to communicate with the individual ink discharge paths 22.

Figure 14:
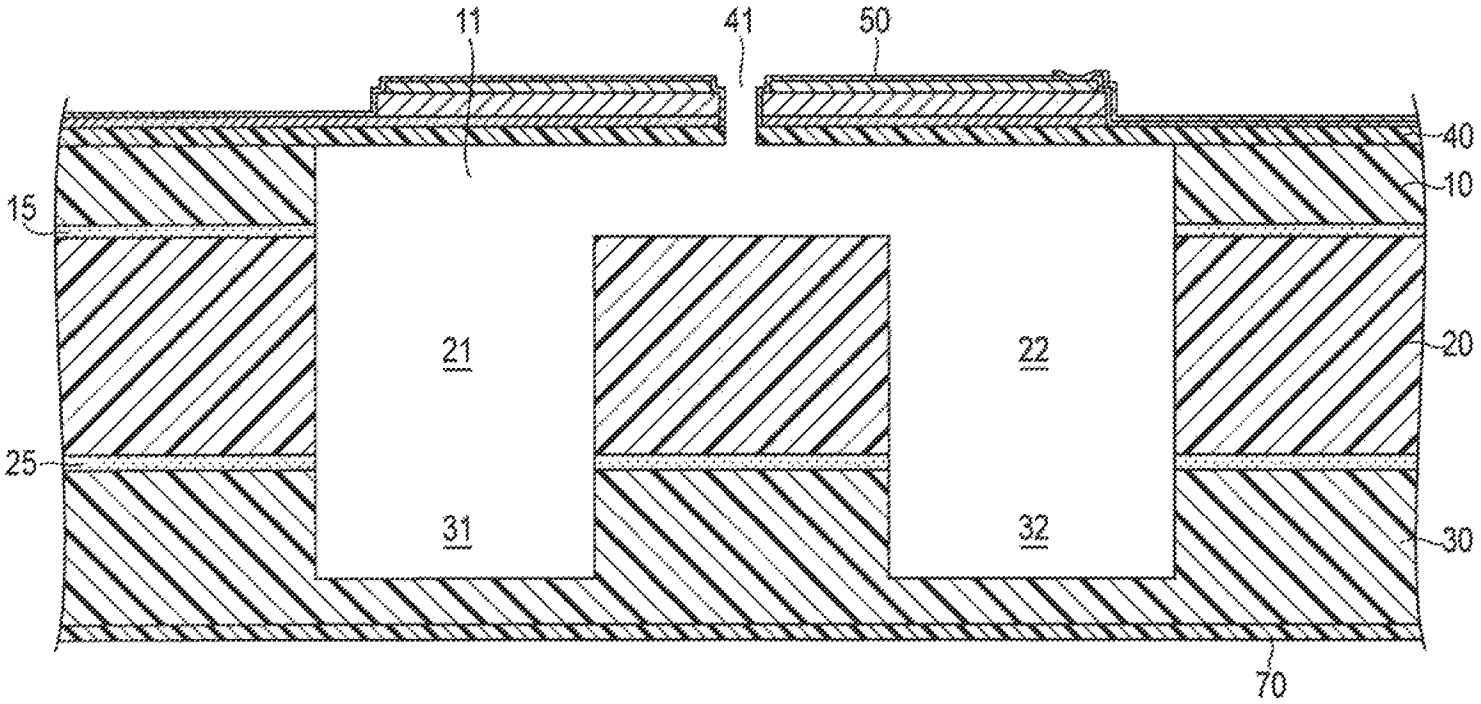

Lastly, the temporarily-fixed substrate 84 is peeled, as shown in FIG. 14. For the peeling, an organic solvent that does not dissolve the adhesive 15, which bonds the driving substrate 10 and the channel substrate 20, and the adhesive 25, which bonds the channel substrate 20 and the supply substrate 30, but dissolves only the temporary fixing adhesive 83 may be used. Alternatively, the peeling may be performed thermally, mechanically, or the like.

The above-described series of deposition and etching steps are performed in such a manner that a large number of chips are simultaneously formed on one wafer. After the processing ends, the wafer is divided into separate chips.

As described above, according to the method of manufacturing the head 100 of the present embodiment, it is possible to manufacture the head 100 by simple processing. It is thus possible to provide a piezoelectric MEMS type inkjet recording head 100 having, in particular, high long-term dielectric strength, high driving durability, high reliability, and high driving efficiency.

(Shape of Ink Pressure Chamber)

According to the first embodiment, the ink pressure chambers 11 formed in the driving substrate 10 are formed by performing back-side photolithography and DRIE from the side of the second surface 10*b* of the driving substrate 10. At this time, etching and passivation of the driving substrate 10 are repeated several times to form the ink pressure chambers 11 with a desired depth. Accordingly, the cavity shape of each of the ink pressure chambers 11 slightly differs between the side of the nozzle plate 40 (side of the first surface 10*a* of the driving substrate 10) and the side of the channel substrate 20 (side of the second surface 10*b* of the driving substrate 10).

Specifically, since the ink pressure chamber 11 is etched from the side of the second surface 10*b* of the driving substrate 10, the cavity shape of the ink pressure chamber 11 on the side of the first surface 10*a* has a small length along the first direction (longitudinal direction) and has a great length along the arrangement direction (transverse direction) at a central portion as viewed in the first direction, compared to the cavity shape of the ink pressure chamber 11 on the side of the second surface 10*b*. For example, as the etch depth further increases, the cavity shape on the side of the first surface 10*a* becomes closer to circular, regardless of the cavity shape on the side of the second surface 10*b*.

Meanwhile, the cavity shapes of the ink pressure chambers on the side of the first surface 10*a* of the driving substrate 10 should desirably be the same oval shape, to arrange the piezoelectric elements 50 in high density on the surface of the head 100. Thus, in the present embodiment, the cavity shape on the side of the second surface 10*b* of the driving substrate 10 is determined in such a manner that the cavity shape on the side of the first surface 10*a* is oval.

Figure 15:
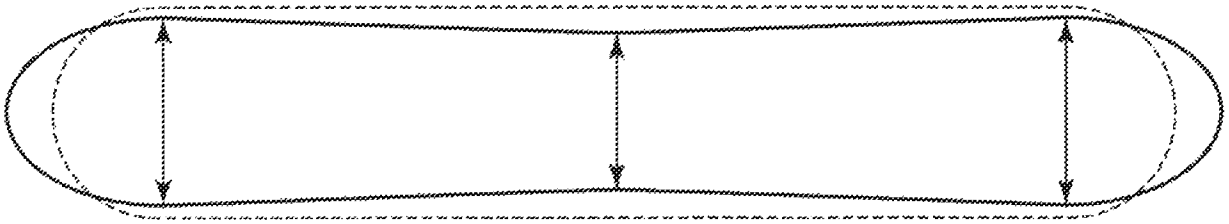
FIG. 15 is a diagram for illustrating the shape of the ink pressure chamber of the inkjet recording head shown in FIG. 1.

Specifically, in the present embodiment, the ink pressure chamber 11 on the side of the second surface 10*b* (where the etching is started) of the driving substrate 10 has a gourd-like cavity shape, as shown by the solid line in FIG. 15. The cavity shape on the side of the second surface 10*b* is constricted and curved at both ends, with the longitudinal length slightly greater than that of the oval cavity shape of the ink pressure chamber 11 on the side of the first surface 10*a* shown by the dotted line in FIG. 15, and the width around the center shorter than the width at both ends as viewed in the longitudinal direction. By thus etching the gourd-shaped cavity on the side of the second surface 10*b*, the cavity shape becomes closer to round as the first surface 10*a* comes closer, thereby obtaining an ideal oval shape.

As described above, according to the present embodiment, by forming the cavity on the side of the second surface 10*b* of the driving substrate 10, where the etching is started, in a gourd shape, namely, a shape that is constricted around the center and is curved at both ends as viewed in the longitudinal direction, the cavity of the ink pressure chamber 11 on the side of the first surface 10*a* is formed in an ideal oval shape, thus allowing a plurality of piezoelectric elements 50 to be arranged in high density.

Furthermore, according to the present embodiment, the cavity of the ink pressure chamber 11 on the side of the second surface 10*b* communicating with the individual ink supply path 21 and the individual ink discharge path 22 is formed in the shape of a gourd. This makes the cavity area of the portion facing the individual ink supply path 21 and the individual ink discharge path 22 relatively large, and decreases the channel resistance between the ink pressure chamber 11 and the individual ink supply path 21 and the channel resistance between the ink pressure chamber 11 and the individual ink discharge path 22, thus favorably circulating the ink.

(Second Embodiment)

Figure 16:
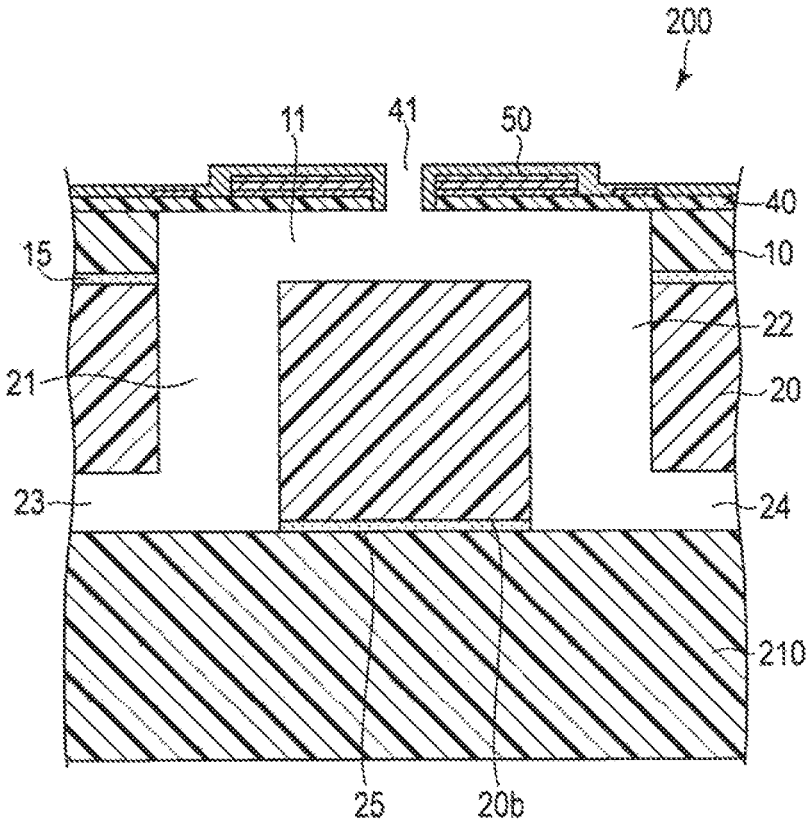
FIG. 16 is a partially enlarged cross-sectional view showing the main part of an inkjet recording head according to the second embodiment.

FIG. 16 is a partially enlarged cross-sectional view showing the main part of an inkjet recording head 200 (hereinafter simply referred to as a head 200) according to the second embodiment. The head 200 of the present embodiment has a configuration substantially the same as that of the above-described head 100 of the first embodiment, except that the head 200 comprises a supporting substrate 210 in place of the supply substrate 30. In the description below, elements different from those of the first embodiment will be described. Elements that perform the same functions as those of the first embodiment will be specified by the same reference numbers, and a detailed description of such elements will be omitted.

The supporting substrate 210 is composed of, for example, silicon, and is bonded to a second surface 20*b* of a channel substrate 20 via an adhesive 25. The supporting substrate 210 is formed in the shape of a flat plate. On the other hand, the channel substrate 20 includes a plurality of individual ink supply paths 21 and a plurality of individual ink discharge paths 22, a common ink supply path 23 connecting the individual ink supply paths 21, and a common ink discharge path 24 connecting the individual ink discharge paths 22.

The common ink supply path 23 is a bottomed groove provided on the side of the second surface 20*b* of the channel substrate 20, and leads to the left side at the lower end of each of the individual ink supply paths 21 in FIG. 16. The common ink discharge path 24 is a bottomed groove provided on the side of the second surface 20*b* of the channel substrate 20, and leads to the right side at the lower end of each of the individual ink discharge paths 22 in FIG. 16. The common ink supply path 23 and the common ink discharge path 24 extend in the arrangement direction of ink pressure chambers 11, and are provided within the thickness of the channel substrate 20.

As described above, since the common ink supply path 23 and the common ink discharge path 24 are provided in the channel substrate 20 in the head 200 of the present embodiment, the supporting substrate 210 does not need to be processed, and the common ink supply path 23 and the common ink discharge path 24 can be formed simultaneously with formation of the individual ink supply paths 21 and the individual ink discharge paths 22, thus simplifying the manufacturing steps of the head 200 and reducing the manufacturing cost.

(Third Embodiment)

Figure 17:
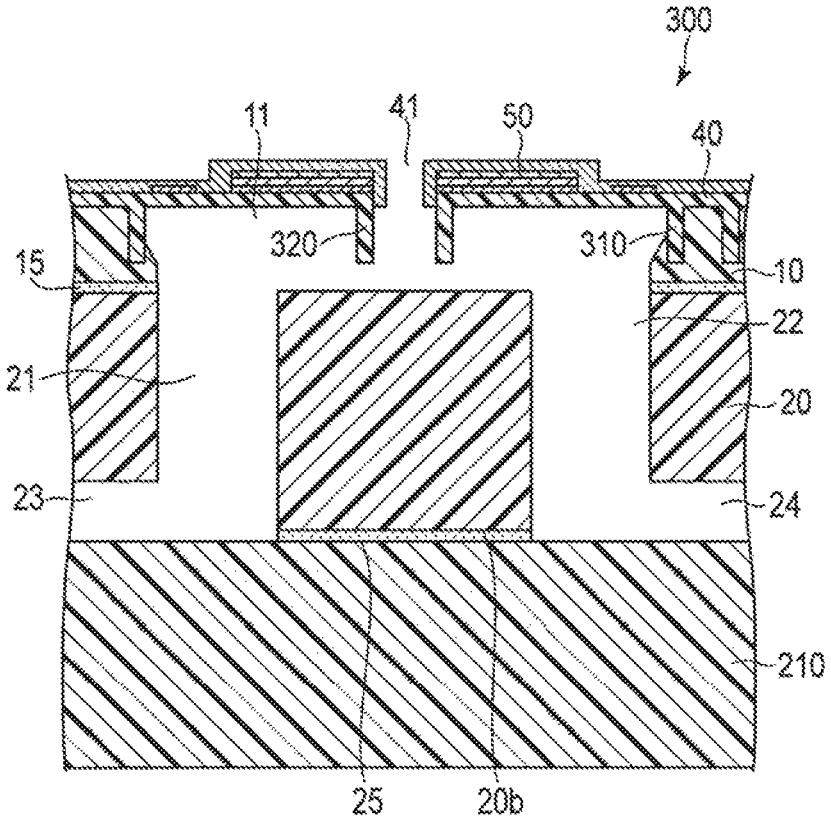
FIG. 17 is a partially enlarged cross-sectional view showing the main part of an inkjet recording head according to the third embodiment.

FIG. 17 is a partially enlarged cross-sectional view showing the main part of an inkjet recording head 300 (hereinafter simply referred to as a head 300) according to the third embodiment. The head 300 comprises a frame-shaped template sidewall 310 on the side of the ink pressure chamber 11 of the nozzle plate 40, and a cylindrical nozzle extension 320 extending the nozzle 41 to the side of the ink pressure chamber 11. Other than that, the configuration of the head 300 is the same as the above-described head 200 of the second embodiment. Therefore, elements that are the same as those of the second embodiment will be specified by the same reference numerals, and a detailed description of such elements will be omitted.

The template sidewall 310 and the nozzle extension 320 are composed of a silicon dioxide film. In the present embodiment, the template sidewall 310 and the nozzle extension 320 are formed simultaneously with formation of the nozzle plate 40 by thermal oxidation. The template sidewall 310 is provided along the outer periphery of the ink pressure chamber 11, and defines the cavity shape of the ink pressure chamber 11 on the side of the nozzle plate 40. The nozzle extension 320 has an approximately cylindrical shape, and extends the nozzle 41 toward the ink pressure chamber 11.

The template sidewall 310 functions as an etching stopper when the ink pressure chamber 11 is formed by DRIE. That is, when the ink pressure chamber 11 is formed by etching the driving substrate 10 from the side of the second surface 10*b*, the template sidewall 310 suppresses further etching. By thus providing the template sidewall 310, the cavity shape of the ink pressure chamber 11 on the side of the first surface 10*a* becomes closer to a desired shape.

Furthermore, the nozzle extension 320 improves precision in discharge angle when ink droplets are discharged via the nozzle 41, and allows the discharge amount of ink droplets to be gradationally controlled. By providing the nozzle extension 320 to increase the overall length of the nozzle 41, the amount of ink droplets to be discharged can be dynamically changed, thus suppressing the problem of air bubbles entering the ink pressure chamber 11 via the nozzle 41 at the time of the discharge.

(Fourth Embodiment)

Figure 18:
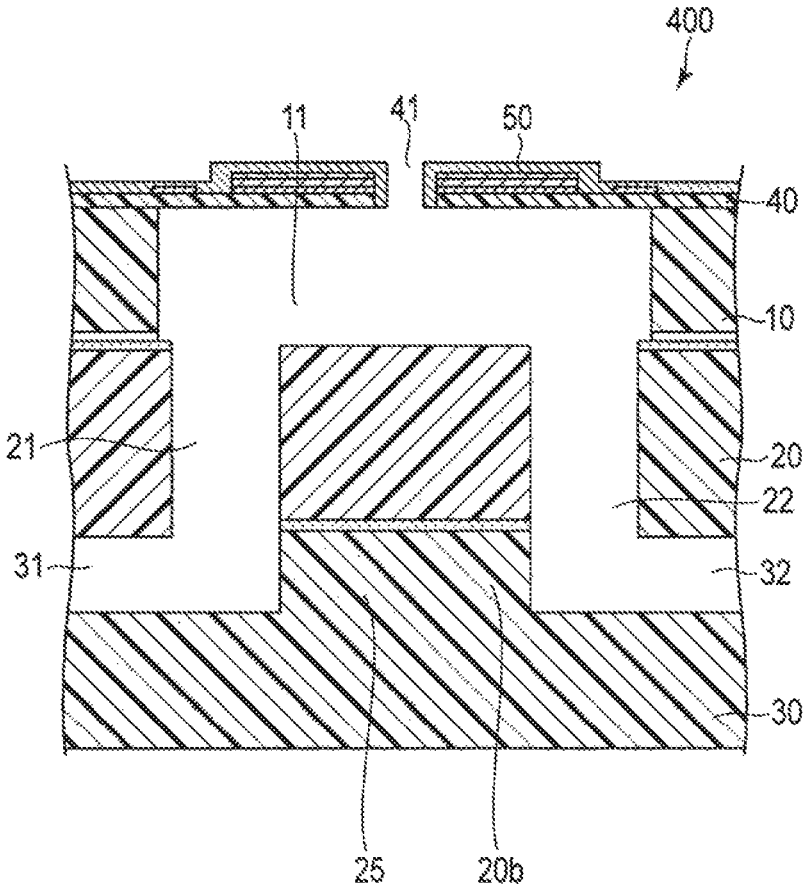
FIG. 18 is a partially enlarged cross-sectional view showing the main part of an inkjet recording head according to the fourth embodiment.

FIG. 18 is a partially enlarged cross-sectional view showing the main part of an inkjet recording head 400 (hereinafter simply referred to as a head 400) according to the fourth embodiment. The head 400 of the present embodiment is configured in such a manner that the driving substrate 10 has an increased thickness, the individual ink supply path 21 extends to the supply substrate 30, the individual ink discharge path 22 extends to the supply substrate 30, and the common ink supply path 31 and the common ink discharge path 32 are shifted in the plane direction. Other than that, the configuration of the head 400 is approximately the same as the above-described head 100 of the first embodiment. In the description below, elements different from those of the first embodiment will be described. Elements that perform the same functions as those of the first embodiment will be specified by the same reference numbers, and a detailed description of such elements will be omitted.

In manufacturing the head 400 of the present embodiment, the step of thinning the driving substrate 10 described with reference to FIG. 11 in the first embodiment is omitted, thereby forming a plurality of ink pressure chambers 11 in the driving substrate 10 with a relatively large thickness. In the present embodiment, a part of the lower end of the individual ink supply path 21 in the drawing, a part of the lower end of the individual ink discharge path 22 in the drawing, the common ink supply path 31, and the common ink discharge path 32 are formed in advance in the supply substrate 30.

As described above, according to the present embodiment, the thickness of the driving substrate 10 is increased to increase the depth of the ink pressure chambers 11, and the lower ends of the individual ink supply path 21 and the individual ink discharge path 22 in the drawing extend to the supply substrate 30. This makes the individual ink channel leading to the nozzle 41 sufficiently long. According to the present embodiment, it is also possible, for example, to reduce the thickness of the channel substrate 20 comprising a part of the individual ink supply paths 21 and the individual ink discharge paths 22, and to omit the channel substrate 20 as the case may be.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the methods described herein may be made without departing from the spirit of the inventions. The accompanying claims and their equivalents are intended to cover such forms or modifications as would fall within the scope and spirit of the inventions.

What is claimed is:

1. An inkjet recording head, comprising:

a first substrate including a plurality of ink pressure chambers arranged in a first direction;

a nozzle plate stacked on a first surface of the first substrate and including, for each of the ink pressure chambers, a nozzle that communicates with each of the ink pressure chambers;

a second substrate stacked on a second surface of the first substrate opposite to the first surface and including a plurality of individual ink supply paths and a plurality of individual ink discharge paths arranged in a thickness direction, each of the individual ink supply paths communicating with one end of a corresponding one of the ink pressure chambers as viewed in the first direction and supplying ink to the corresponding ink pressure chamber, and each of the individual ink discharge paths communicating with another end of the corresponding ink pressure chamber as viewed in the first direction and discharging ink from the corresponding ink pressure chamber;

a plurality of actuators each provided around the nozzle on a surface of the nozzle plate opposite to the first substrate and configured to apply pressure to ink in the corresponding ink pressure chamber, wherein the ink pressure chambers are elongated holes communicating with the first surface and the second surface of the first substrate so as to penetrate the first substrate, and extending in the first direction, a cavity shape of the ink pressure chamber on a side of the first surface is an oval shape having a greater length in the first direction, and a cavity shape of the ink pressure chamber on a side of the second surface has a greater length in the first direction than the oval shape, and has a smaller width at a central part than a width at the ends as viewed in the first direction.

2. The inkjet recording head of claim 1, further comprising:

a third substrate stacked on a side of the second substrate opposite to the first substrate and including a common ink supply path and a common ink discharge path, the common ink supply path communicating with an end of each of the individual ink supply paths on a side opposite to the corresponding ink pressure chamber, and the common ink discharge path communicating with an end of each of the individual ink discharge paths on a side opposite to the corresponding ink pressure chamber.

3. The inkjet recording head of claim 2, wherein an individual ink channel including the ink pressure chamber, the individual ink supply path, and the individual ink discharge path has a cross-sectional area of 5000 $\mu m^2$ to 30000 $\mu m^2$ over the entire length, the individual ink supply path and the individual ink discharge path being connected to the ends of the ink pressure chamber.

4. The inkjet recording head of claim 3, wherein both of a length of a channel extending from the nozzle through the ink pressure chamber and the individual ink supply path to the common ink supply path and a length of a channel extending from the nozzle through the ink pressure chamber and the individual ink discharge path to the common ink discharge path are 500 μm to 1250 μm.

5. The inkjet recording head of claim 3, wherein the individual ink supply paths and the individual ink discharge paths are holes penetrating the second substrate in a thickness direction, and a sum of a thickness of the first substrate and a thickness of the second substrate is 500 μm or greater.

6. The inkjet recording head of claim 2, wherein the end of each individual ink supply path on the side opposite to the corresponding ink pressure chamber, and the end of each individual ink discharge path on the side opposite to the corresponding ink pressure chamber extend to the third substrate.

7. The inkjet recording head of claim 1, wherein each individual ink supply path and each individual ink discharge path communicate with the corresponding ink pressure chamber in such a manner that the individual ink supply path and the individual ink discharge path face respective widened ends of a cavity of the ink pressure chamber on the side of the second surface.

8. The inkjet recording head of claim 1, wherein the second substrate includes a common ink supply path and a common ink discharge path, the common ink supply path communicating with the end of each of the individual ink supply paths on the side opposite to the corresponding ink pressure chamber, and the common ink discharge path communicating with the end of each of the individual ink discharge paths on the side opposite to the corresponding ink pressure chamber.

9. An inkjet recording head, comprising:

a first substrate including a plurality of ink pressure chambers communicating with a first surface and a second surface opposite to the first surface and arranged in a first direction;

a nozzle plate stacked on the first surface of the first substrate and including a plurality of nozzles each communicating with a corresponding one of the ink pressure chambers;

a second substrate stacked on the second surface of the first substrate and including a plurality of individual ink supply paths and a plurality of individual ink discharge paths, each of the individual ink supply paths communicating with an end of the corresponding one of the ink pressure chambers as viewed in the first direction, and each of the individual ink discharge paths communicating with another end of the corresponding ink pressure chamber as viewed in the first direction; and a plurality of actuators each provided around the nozzle on a surface of the nozzle plate opposite to the first substrate and configured to apply pressure to ink in the corresponding ink pressure chamber, wherein a cavity shape of the ink pressure chamber on a side of the first surface is an oval shape having a greater length in the first direction, and a cavity shape of the ink pressure chamber on a side of the second surface has a greater length in the first direction than the oval shape, and has a smaller width at a central part than a width at the ends as viewed in the first direction.

10. The inkjet recording head of claim 9, wherein each of the individual ink supply paths and each of the individual ink discharge paths communicate with the corresponding ink pressure chamber in such a manner that each individual ink supply path and each individual ink discharge path face respective widened ends of a cavity of the corresponding ink pressure chamber on the side of the second surface.

11. The inkjet recording head of claim 10, wherein an individual ink channel including the ink pressure chamber, the individual ink supply path, and the individual ink discharge path has a cross-sectional area of 5000 $\mu m^2$ to 30000 $\mu m^2$ over the entire length, the individual ink supply path and the individual ink discharge path being connected to the ends of the ink pressure chamber.

12. The inkjet recording head of claim 10, wherein the individual ink channel connecting the ink pressure chamber, the individual ink supply path, and the individual ink discharge path has a length of 1000 μm to 2500 μm.

13. The inkjet recording head of claim 10, wherein the individual ink supply paths and the individual ink discharge paths are holes penetrating the second substrate in a thickness direction, and a sum of a thickness of the first substrate and a thickness of the second substrate is 500 μm or greater.

* * * * *